US011180296B2

(12) United States Patent
Bangera et al.

(10) Patent No.: US 11,180,296 B2
(45) Date of Patent: Nov. 23, 2021

(54) DOSER CAP FOR LIQUID CONTAINER

(71) Applicant: STEERLIFE INDIA PRIVATE LIMITED, Bengaluru (IN)

(72) Inventors: Subba Bangera, Mumbai (IN); Babu Padmanabhan, Bengaluru (IN); Ravi Bangera, Mumbai (IN); Rohit Jagtap, Mumbai (IN); Kaustubh Kulkarni, Bengaluru (IN)

(73) Assignee: STEERLIFE INDIA PRIVATE LIMITED, Bengaluru (IN)

( * ) Notice: Subject to any disclaimer, the term of this patent is extended or adjusted under 35 U.S.C. 154(b) by 165 days.

(21) Appl. No.: 16/494,167

(22) PCT Filed: Mar. 14, 2018

(86) PCT No.: PCT/IB2018/051692
§ 371 (c)(1),
(2) Date: Sep. 13, 2019

(87) PCT Pub. No.: WO2018/167681
PCT Pub. Date: Sep. 20, 2018

(65) Prior Publication Data

US 2020/0079559 A1 Mar. 12, 2020

(30) Foreign Application Priority Data

Mar. 15, 2017 (IN) ..... 201741008925

(51) Int. Cl.
*B65D 51/28* (2006.01)
*B65D 41/34* (2006.01)

(52) U.S. Cl.
CPC ..... *B65D 51/2835* (2013.01); *B65D 41/3447* (2013.01)

(58) Field of Classification Search
CPC .... B65D 47/38; B65D 47/36; B65D 43/0218; B65D 43/0216; B65D 43/0214; B65D 43/0212; B65D 43/021; B65D 43/0208; B65D 43/0206; B65D 43/0204; B65D 43/0202; B65D 43/02; B65D 51/2835; B65D 41/3447
See application file for complete search history.

(56) References Cited

U.S. PATENT DOCUMENTS

| | | | | |
|---|---|---|---|---|
| 3,786,954 | A | 1/1974 | Shull | |
| 6,644,471 | B1 | 11/2003 | Anderson | |
| 7,896,155 | B2 | 3/2011 | Seelhofer | |
| 8,443,970 | B2 | 5/2013 | Coon | |
| 8,490,786 | B2 * | 7/2013 | Rohr | B65D 51/2864 206/221 |

(Continued)

FOREIGN PATENT DOCUMENTS

| | | |
|---|---|---|
| EP | 2167395 | 3/2010 |
| WO | 2000/010884 | 3/2000 |
| WO | 2016/016845 | 2/2016 |

*Primary Examiner* — Kareen K Thomas
(74) *Attorney, Agent, or Firm* — Workman Nydegger

(57) ABSTRACT

A doser cap for liquid containers can include a cap having a storage chamber enclosing powder material or active substance that can be dispensed into the liquid container by rupturing an associated seal. The doser cap can include a bottom cap, top cap, cutting unit, spiral cam slot, pushing rib, and entry groove on top cap.

10 Claims, 10 Drawing Sheets

(56) References Cited

U.S. PATENT DOCUMENTS

Figure 1:
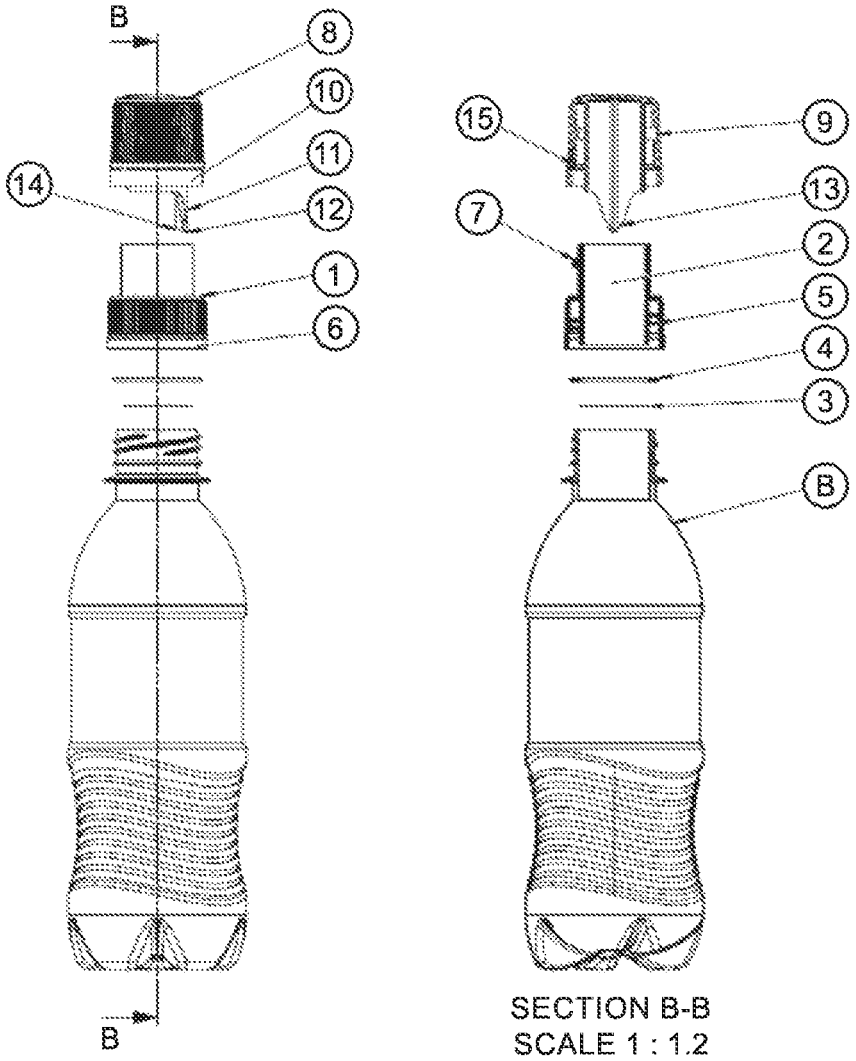

| | | | | |
|---|---|---|---|---|
| 8,613,372 | B2 * | 12/2013 | Porter | B65D 51/2821 220/521 |
| 8,640,865 | B2 * | 2/2014 | Smart | B65D 51/2835 206/219 |
| 9,242,772 | B1 * | 1/2016 | Anderson | B65D 51/2835 |
| 9,242,773 | B1 * | 1/2016 | Anderson | B65D 51/2835 |
| 9,365,335 | B2 | 6/2016 | Burgess et al. | |
| 9,758,283 | B2 * | 9/2017 | Prost | B65D 51/2842 |
| 2010/0200536 | A1 | 8/2010 | Van den Broek et al. | |
| 2010/0236952 | A1 * | 9/2010 | Masterson | B65D 51/2835 206/222 |
| 2011/0174642 | A1 * | 7/2011 | Coon | B65D 51/2835 206/222 |
| 2015/0217914 | A1 | 8/2015 | Burgess et al. | |
| 2016/0220446 | A1 | 8/2016 | Perovitch | |
| 2016/0264323 | A1 | 9/2016 | Jeon | |

* cited by examiner

DETAIL I
SCALE 5 : 1

DOSER CAP FOR LIQUID CONTAINER

CROSS REFERENCE TO RELATED APPLICATIONS

This application is a United States nationalization under 35 U.S.C. 371 of International Application No. PCT/IB2018/051692, filed Mar. 14, 2018, which claims priority to and the benefit of Indian Patent Application No. 201741008925, filed Mar. 15, 2017. Each of the foregoing are incorporated herein by this reference in their entirety.

FIELD OF INVENTION

The present invention relates to a doser cap for liquid containers. More particularly, the present invention relates to a doser cap for liquid container, wherein the cap has storage chamber enclosing powder material or active substances that can be dispensed in to the liquid container for instant preparation of a solution or suspension.

BACKGROUND OF THE INVENTION

Nutritional and health supplements are the norm of day-to day activities, mostly indoor and outdoor sports. It is desirable and beneficial to have fortified water, juices, fruit drinks; freshly prepared. Besides, instant preparation of beverages or supplements by mixing with water is a viable option in case of substances like vitamins which have a short-shelf life in aqueous solutions at normal temperature.

U.S. Pat. No. 6,644,471 describes a capsule that is inserted into the neck of a bottle, or within a pull-up liquid dispenser cap, said capsule being a container or receptacle for sealably containing a liquid and/or dry material and a dispenser for releasing the material when desired into the bottle through the orifice previously occupied by the first and second plugs frangibly sealed in a first position and unsealed mechanically by depressing an elongated shaft releasing the liquid and/or dry materials into the container body in second position.

U.S. Pat. No. 9,365,335 relates to a closure cap for a container, said closure cap having a cap housing including a substantially cylindrical recess with a top opening and a bottom opening, wherein the bottom opening is closed by means of a pierceable membrane, a plunger comprising a cover and a substantially cylindrical lateral surface extending downward from the underside of the cover, wherein the lateral surface engages in the top opening of the recess and has an outside diameter corresponding substantially to the inside diameter of the recess, and a chamber defined by the cylindrical recess and the plunger which engages in the recess by way of its lateral surface, the plunger and the cap housing being arranged so as to be movable relative to one another between a first, non-active position, in which a bottom edge of the lateral surface is arranged above the membrane of the cap housing and in which the plunger is blocked from being vertically pressed into the recess of the cap housing, and a second, activated position, in which the bottom edge of the lateral surface opens the membrane, United States patent application, published as US20160264323A1 relates to a capsule cap for a beverage container and, more particularly, to a capsule cap for a beverage container that separately keeps an additive to be mixed and drinking water in the beverage container and allows for opening the beverage container and dropping the additive at the same time by changing torque into straight force using spiral guides, and increases pressing force of a cutting unit by forming a vertical guide groove at the cutting unit.

U.S. Pat. No. 7,896,155 describes to a capsule closure, the cap of which comprises a receptacle (2) that is formed on the interior of the lid and that fits into the interior of a corresponding nipple part (3). An associated film-sealed container capsule (8) can be locked into the interior of the receptacle (2), with the film facing downwards (9), so that the sealing film (9) lies against the inner diameter of the cap (1). A circular shoulder that projects inwards (10) is configured in the interior of the nipple part (3) below the inserted container capsule (8). Several fixed and/or displaceable piercing and/or cutting elements (12) are formed on the inner edge (11) of said shoulder (10).

WO2016016845 describes a dual chamber pack for a multi-dose oral liquid pharmaceutical composition where in the compositions of the first and second chambers. Here the flute-shaped plunger (3) in a snuggly fitted plug (4) or dome-shaped plunger (3) ruptures the polymeric membrane or (5) by a screw-based mechanism.

U.S. Pat. No. 8,443,970 describes a dispensing capsule with a diaphragm button, stake and frangible membrane for selectively dispersing the contents of a cup into an attached bottle.

European patent no. EP2167395 B1 describes caps for bottles with the box for powder material for preparation of beverages. It consists of the box (1) closed on the bottom-side with the aluminium foil (8) and slant damper (9) and on the upper side by the cover (2). The damper (9) that may be twisted round the hinge (O) and which have on the upper surface a one-arm vertical flexible lever (11) arranged above the aluminium foil (18). The cover (2) has on the internal plane of the bottom tangs (13) and (14), as well as the barrier (17) by which during winding up and winding off it acts on the lever (11). By winding off the cover (2) the free end of the lever (11) is elastically bended, creating in it the moment of force, which twists the damper (9) which breaks through and removes the aluminium foil (8).

The existing state of art suffers from disadvantage of being complex and multifaceted. More the complexity in the components in the interior of the cap-discharge assembly more is the uncertainty in performance of the product. The dispensing cap system more often is too complicated. Inclusion of multiple components in the cap assembly adds significantly to the operational and manufacturing costs.

The inventors of the present invention have surprisingly developed a doser cap for liquid container that comprises top cap with cutting element and bottom cap with additive/powder material/undiluted solutions/liquid concentrates which is simple in function, construction and implementation. In addition to that, it is cost-effective and user friendly.

Object of the Invention

It is an object of the present invention, to provide a doser cap enclosing powdered material or undiluted solution comprising a top cap with characteristic cutting unit and cam slot and bottom cap with a characteristic cam guide.

SUMMARY OF THE INVENTION

According to an aspect of the present invention there is provided a doser cap for a liquid container, enclosing additives for release in the said liquid container comprising;

a) a bottom cap unit comprising internal thread to engage with thread on the liquid container, a reservoir shaft, wherein the bottom side of the shaft is sealed and wherein the bottom cap unit has a cam guide on outer portion of the reservoir shaft;

b) a top cap unit comprising a cam slot that engages with the cam guide on bottom cap unit, such that the top cap moves spirally down or up as per direction of rotation; and a peel-off ring which is in contact with the bottom cap and top cap units; the top cap unit being characterized by, i) a cutting unit having a cutting tip, for piercing the seal of the reservoir shaft of the bottom cap unit and cutting edge on the inner portion of the top cap unit for shearing the seal on rotation of top cap unit in desired direction to discharge the additives from the said reservoir shaft of the bottom cap unit and wherein, the cutting unit resides inside the reservoir shaft;

ii) an optional, pushing rib perpendicular to cutting unit, for preventing the said seal from pushing back upwards when cut or sheared; and iii) an optional, entry groove for smooth entry of the cam guide, into the cam slot of the top cap unit, locking the bottom cap unit with the top cap unit.

BRIEF DESCRIPTION OF THE ACCOMPANYING DRAWINGS

FIG. 1: Exploded perspective view showing Doser cap for liquid container.

Figure 2:
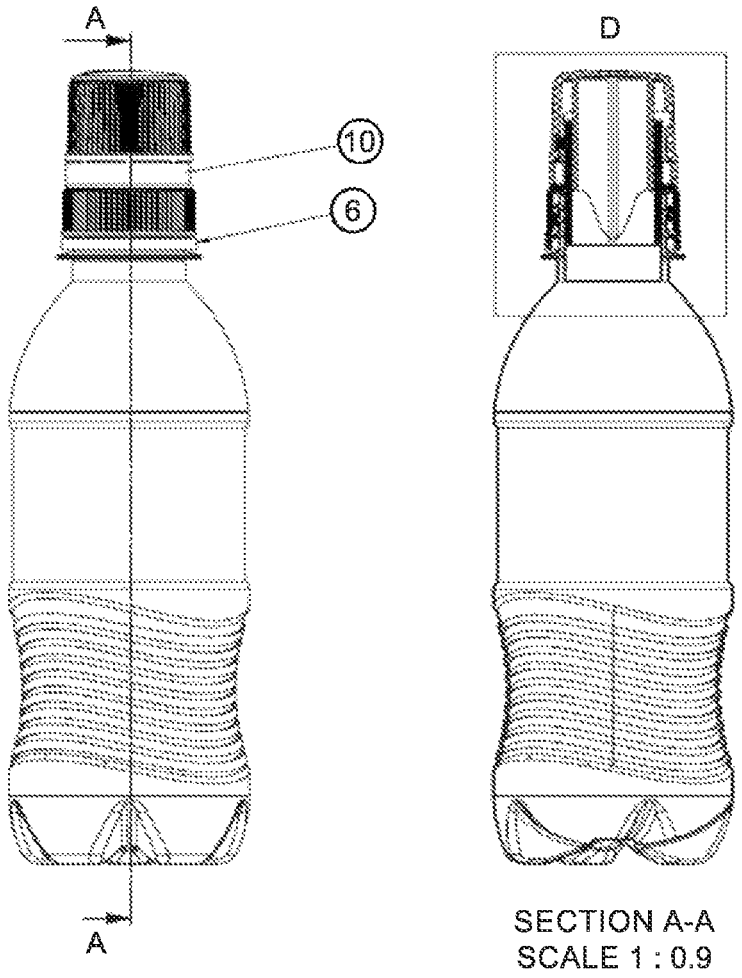

FIG. 2: Closed position view of Doser cap.

Figure 3:
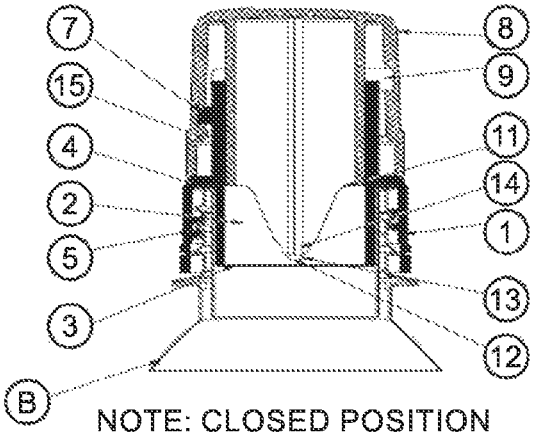

FIG. 3: Detail view D from FIG. 2, showing section view of Doser cap in closed position.

Figure 4:
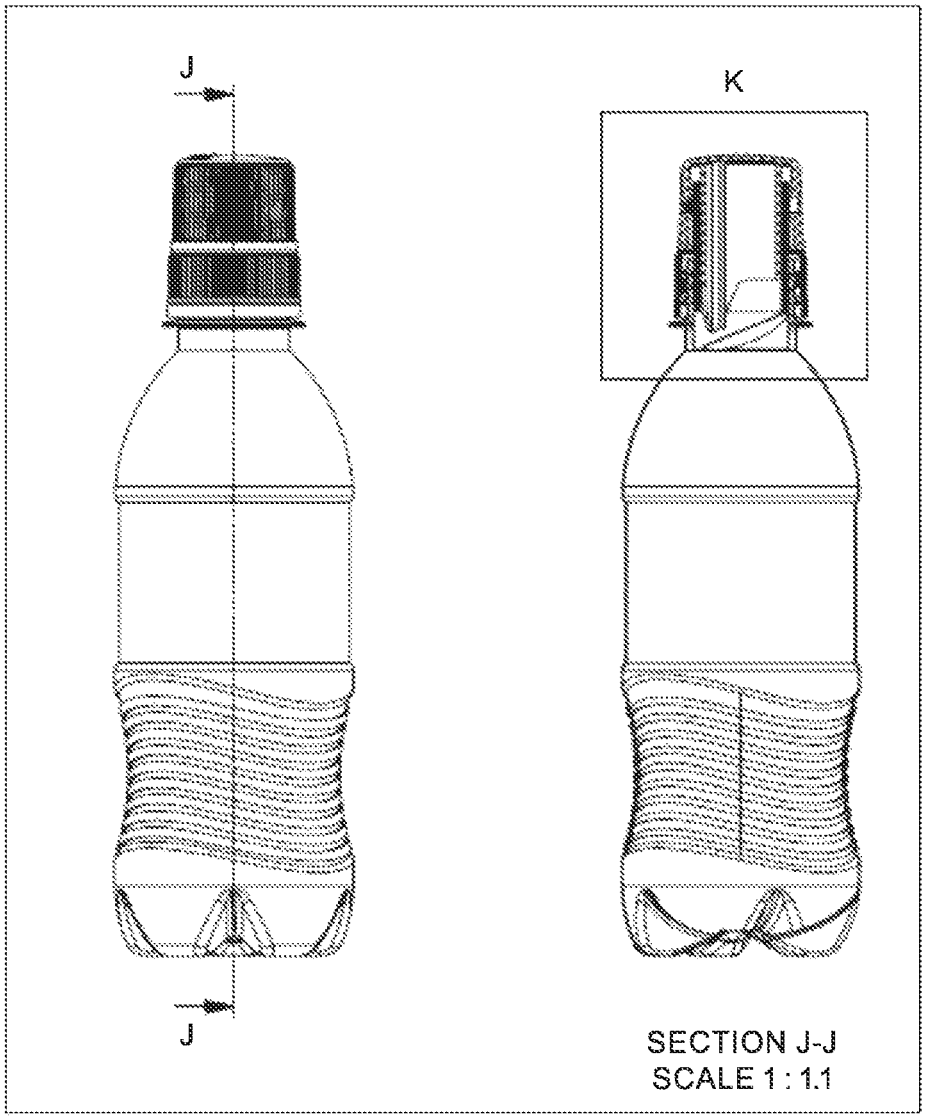

FIG. 4: Open position view of Doser cap.

Figure 5:
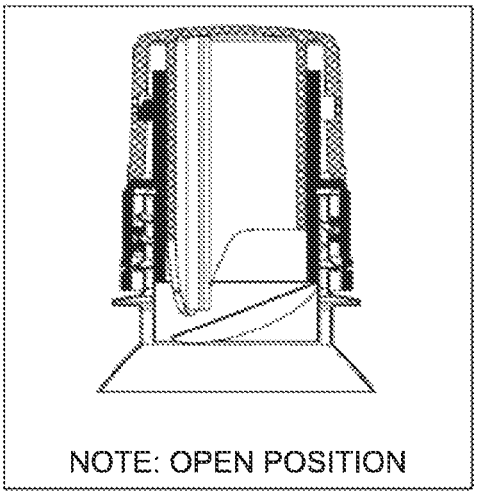

FIG. 5: Detail view K from FIG. 4, showing section view of Doser cap in open position.

Figure 6:
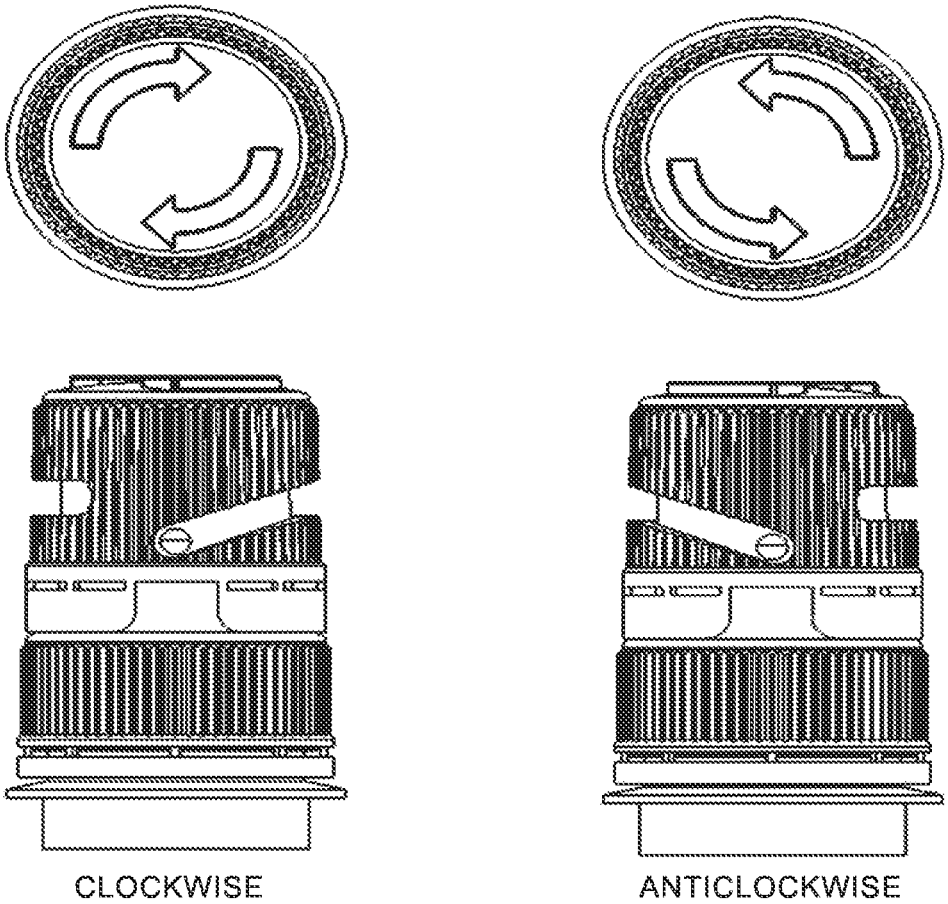

FIG. 6: Clockwise and Anti-clockwise position view of Doser cap.

Figure 7:
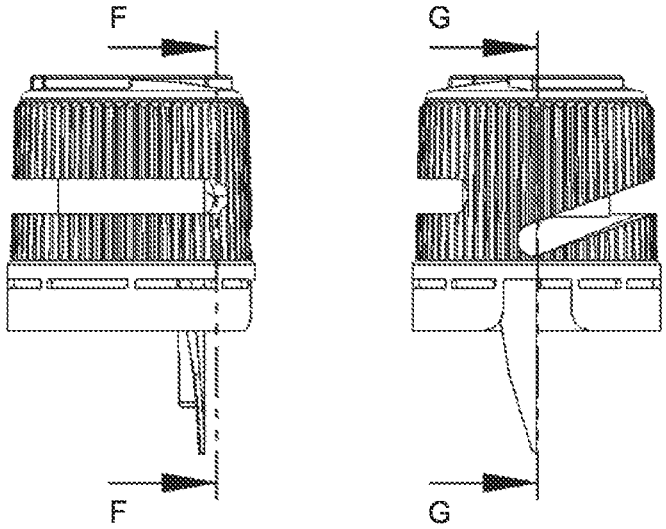

FIG. 7: Exploded perspective view showing alternative Doser cap cutting unit design, for liquid container.

Figure 8:
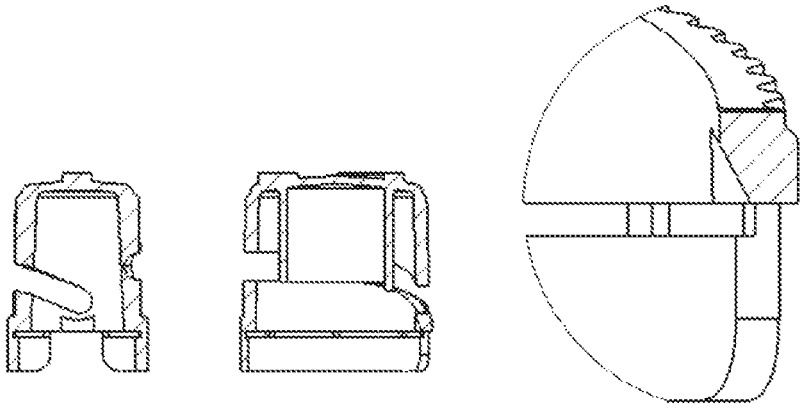

FIG. 8: Sectional view of the entry groove.

Figure 9:
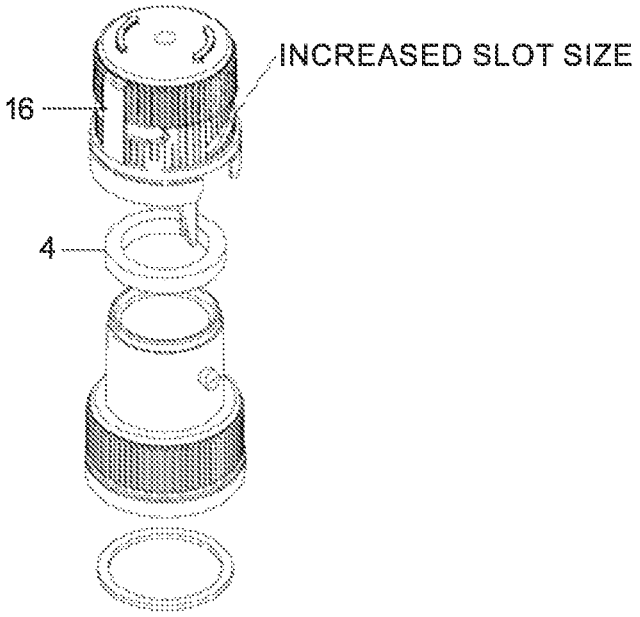

FIG. 9: An embodiment of the present invention with pair of columns

Figure 10:
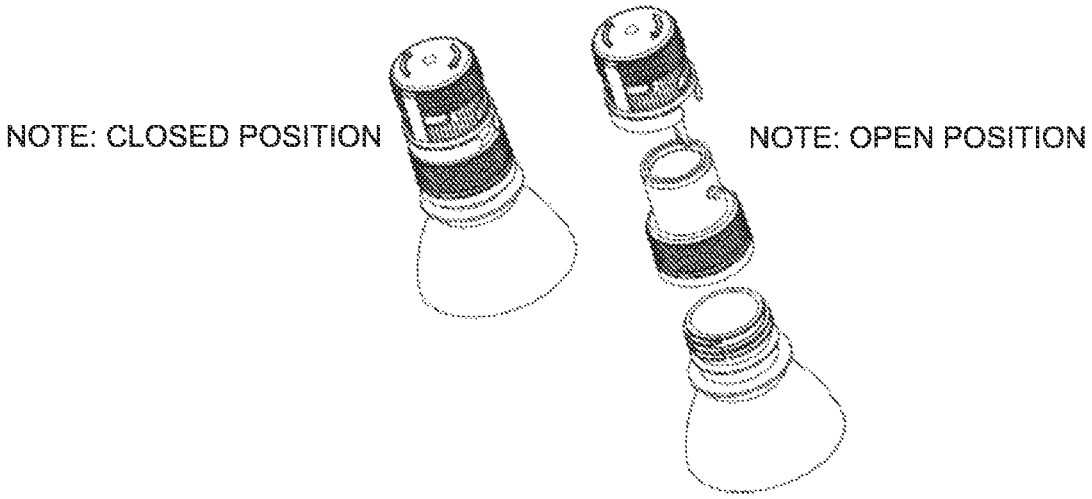

FIG. 10: Embodiment of FIG. 9 in closed and open position.

DETAILED DESCRIPTION OF THE INVENTION

The following description with reference to the accompanying drawings is provided to assist in a comprehensive understanding of exemplary embodiments of the invention. It includes various specific details to assist in that understanding but these are to be regarded as merely exemplary.

The terms and words used in the following description and claims are not limited to the bibliographical meanings, but, are merely used by the inventor to enable a clear and consistent understanding of the invention. Accordingly, it should be apparent to those skilled in the art that the following description of exemplary embodiments of the present invention are provided for illustration purpose only and not for the purpose of limiting the scope of the invention as defined by the appended claims and their equivalents.

The present invention is described in connection with such embodiments, but the invention is not limited to any embodiment. The scope of the invention is limited only by the claims and the invention encompasses numerous alternatives, modifications and equivalents. Numerous specific details are set forth in the following description in order to provide a thorough understanding of the invention. These details are provided for the purpose of example and the invention may be practiced according to the claims without some or all of these specific details. For the purpose of clarity, technical material that is known in the technical fields related to the invention has not been described in detail so that the invention is not unnecessarily obscured.

The present invention relates to doser caps for liquid containers. More particularly, the doser caps of the present invention can hold substances like physiologically active substances or health supplements, electrolytes, nutrients, minerals, sweeteners, colorants, flavors, vitamins, proteins; as powders/liquid concentrates. These may also be suitable to hold nutritional and recreational food products or beverages. Further, dosage forms like single or multiple unit dosage forms or spheres can be packed inside the doser cap. These substances held in the doser cap can be introduced into the liquid container without unscrewing the cap, off the container, to form a ready to drink suspension or solution. The doser cap is a tamper resistant and single time usable cap, i.e. this cap can be used once only.

The doser cap according to the invention is designed in a simple manner, such that the dispensing system is essentially formed by just two components which are fitted into one another. The walls of the two components form effective sealing of the reservoir, such that the additives in the reservoir are protected effectively from environmental influences until the additives are released into the liquid container.

The top and bottom units are closely fitted and the cutting unit resides inside the reservoir shaft in a non-active position along with the additives. A peel-off ring serves dual purpose of tamper evidence, as well as provides protection against accidental rotation of the top unit. The peel-off ring must be separated from the top and bottom units before rotating the top unit. The peel-off ring can be designed to be circular with a provision to peel off, or be an incomplete circle to facilitate removal by end user.

After separation, the doser cap is ready to dispense its contents into the liquid container. On rotating the top cap unit, the cutting unit is set into a spirally downward motion, till it pierces the seal of the reservoir shaft. The additives housed inside the reservoir shaft are discharged into the liquid in the container, as the cutting unit systematically cuts the seal along its circumference, during its spirally downward movement.

In an aspect of the present invention, the cutting unit, of the top cap unit, of the doser cap, has a pushing rib.

The pushing rib prevents the cut portion of the seal, from pushing back upwards, and assists in emptying the entire contents of the reservoir shaft into the liquid container. In case of seals made of materials, which do not resist the cutting unit when sheared along the circumference, a pushing rib is optional.

In an aspect of the present invention, the cutting unit of the top cap unit of the doser cap has an entry groove for the cam guide into the cam slot. For top cap units made of flexible materials, the entry groove is optional. While the cam slot assists the cam guide into the cam slot, it prevents the top cap unit from being separated from the bottom cap unit.

According to an aspect of the present invention there is provided a doser cap for a liquid container, enclosing additives for release in the said liquid container comprising;

a) a bottom cap unit (1) comprising internal thread to mesh with thread on liquid container, a reservoir shaft (2)

enclosing the additives wherein the bottom side of reservoir shaft is sealed with seal (3) and annular liner (4) housed around the reservoir shaft, wherein the bottom cap unit (1) has an internal thread (5) and peel off seal (6) and wherein the bottom cap unit (1) has a cam guide (7);

b) a top cap unit (8) comprising a cam slot (9) that engages with cam guide (7) on bottom cap unit (1) such that top cap (8) moves spirally down or up as per direction of rotation; and a peel-off ring (10);the top cap unit being characterized by, i) a cutting unit (11) having a cutting tip (12) and cutting edge (13) formed on the inner portion of the top cap unit (1), wherein the cutting tip (12) pierces the seal (3), and cutting edge (13) shears the seal (3) on rotating of top cap unit (8) in desired direction to discharge the additives from the said reservoir shaft (2);

ii) the pushing rib (14) formed perpendicular to cutting unit (11) preventing the said seal from pushing back upwards when cut or sheared; and iii) the entry groove (15) for smooth entry of cam guide (7) on reservoir shaft (2) into cam slot(9) on the top cap (8), locking the bottom cap unit (1) with the top cap unit (8).

According to an embodiment of the present invention there is provided a doser cap comprising bottom cap, top cap, cutting unit, spiral cam slot, pushing rib, and entry groove on top cap.

According to an embodiment of the present invention, there is provided a doser cap for a liquid container, enclosing additives for release in the said liquid container comprising;

a) a bottom cap unit comprising internal thread to engage with thread on the liquid container, a reservoir shaft, wherein the bottom side of the shaft is sealed and wherein the bottom cap unit has a cam guide on outer portion of the reservoir shaft;

b) a top cap unit comprising a cam slot that engages with the cam guide on bottom cap unit, such that the top cap moves spirally down or up as per direction of rotation; and a peel-off ring which is in contact with the bottom cap and top cap units; the top cap unit being characterized by, i) a cutting unit having a cutting tip, for piercing the seal of the reservoir shaft of the bottom cap unit and cutting edge on the inner portion of the top cap unit for shearing the seal on rotation of top cap unit in desired direction to discharge the additives from the said reservoir shaft of the bottom cap unit and wherein, the cutting unit resides inside the reservoir shaft;

ii) an optional, pushing rib perpendicular to cutting unit, for preventing the said seal from pushing back upwards when cut or sheared; and iii) an optional, entry groove for smooth entry of the cam guide, into the cam slot of the top cap unit, locking the bottom cap unit with the top cap unit.

In a further embodiment, the doser cap the bottom cap unit has a provision to be sealed with the mouth of the liquid container by a peel-off seal.

In a further embodiment, the bottom cap unit further comprises of an annular liner housed around the reservoir shaft.

In a further embodiment, the desired direction to discharge the additives is in the anti-clockwise direction.

In a further embodiment, the desired direction to discharge the additives is in the clockwise direction.

In a further embodiment, the entry groove is provided for smooth entry and assembly of top and bottom cap units.

In a further embodiment, the pushing rib perpendicular to cutting unit is provided, for preventing the said seal from pushing back upwards when cut or sheared.

In a further embodiment, the reservoir shaft has a capacity of up to about 7.5 ml.

In a further embodiment, the cap is made from polypropylene co-polymers.

According to an embodiment of the present invention, the doser cap of the present invention is fastened by means of internal thread on bottom cap and external thread on liquid container. In a preferred embodiment, the container can be a beverage container.

According to an embodiment of the present invention there is provided a cap for beverage container that seals beverage container and allows the user to discharge enclosed additives, such as powder or an undiluted solution as per the discretion of the user in to the beverage container (B); as shown in FIG. 1, comprises:

a bottom cap unit (1) composed of i)internal thread to mesh with thread on beverage container (B), ii) a reservoir shaft (2) to store additives, iii) having a seal (3) to separate additives and beverage, iv) further having an annular ring(4) to avoid leakage of beverage when internal thread (5) of bottom cap, is screwed on beverage container (B), v) further having an outer peel-off seal (6) which is engaged with beverage container (B), wherein the said outer peel-off seal (6) is to be broken when the bottom cap is unscrewed, and (vi) protrusion on outer side of reservoir shaft located near the top, which acts as cam guide (7) and locator for top cap unit (8), as shown FIG. 1.

a top cap unit (8) comprising i) cam slot (9) which is engaged with ii) cam guide (7) on bottom cap unit (1), which allows top cap to move down or up as per direction of rotation, iii) a peel-off ring (10) which can prevent accidental rotation of top cap, wherein the top cap can only be rotated when peel-off seal is removed by user just before use; as shown in FIGS. 1, 2 and 3.

a cutting unit (11) consisting of cutting tip (12) and cutting edge (13), wherein the cutting tip (12) pierces the seal (3), and cutting edge(13) shears the seal (3) when top cap unit (8) is rotated in desired direction, discharging the additives from reservoir shaft (2); as shown in FIGS. 4 and 5.

a spiral cam slot (9) on top cap unit to push cutting tip(12) in downward motion piercing/rupturing the seal (3) on below the bottom cap unit, cutting edge(13) to further shear the seal(3), on further rotation of top cap unit so that the contents in the reservoir can be dropped/discharged into the container.

a pushing rib (14)perpendicular to cutting unit (11) to prevent the seal (3) from pushing back up once sheared by cutting unit; as shown in FIG. 4 and FIG. 5.

an entry groove (15) for smooth entry of cam guide (7) on bottom cap into cam slot (9) on the top cap, with the cam guide (7) having slight opening angle at top for easy entry and with no angle at back to avoid separation of top and bottom cap units without breaking peel off ring (10) as shown in FIG. 2 and FIG. 3.

According to an embodiment of the present invention, once bottom cap unit (1) and top cap unit (8) are assembled with peel-off ring (10), top cap can only move downward as it is guided by cam slot(9) and cam guide (7). The peel off ring (10) blocks the downward motion of top cap. The peel-off ring (10) in addition to functioning as tamper-evident seal also avoids accidental discharge of the additives; as shown FIGS. 2 and 3.

In an embodiment, the top cap cam slot can be designed so that the top cap can move downward in a clockwise direction.

In an alternative embodiment, the top cap cam slot can be designed so that the top cap can move downward in an anti-clockwise direction.

According to an embodiment of the present invention, the top cap unit (1) of doser cap rests on the bottom cap unit. Top cap unit (8) is in direct communication with the bottom cap unit (1) by means entry groove (15). The entry groove (15) is provided for smooth entry of cam guide (7) on bottom cap into cam slot (9) on the top cap, making sure that cap are locked with each other at right place during assembly, cam guide (7) has a slight opening angle at top for easy entry and since there is no angle at the back it will be difficult to separate caps without breaking peel off seal (10) as shown FIGS. 2 and 3. The entry groove is necessary if the material of the top cap is a hard material with less flexibility. For softer materials, the entry groove is optional. Also, the location of the entry groove can be at any point along the circumference of the top cap unit.

In non-active position, the peel-off ring avoids accidental discharge of the additives into the liquid container. This also prevents the pushing rib from accidently damaging the seal. Therefore, it provides child-resistance, tamper-evidence as well as it facilitates damage free transport during shipping. It is also a viable alternative for dispensing of unit doses.

Removal of peel-off ring (10) brings the doser cap of the present invention in active form. In an embodiment of the present invention this may be referred to as in-between position wherein the cap assembly of the present invention is ready for discharging the contents. Further rotation of the top cap causes the cutting unit (11) with cutting tip (12) and cutting edge (13) to move in spirally downward direction, first puncturing and then cutting the seal (3) along its circumference, at the bottom cap releasing the contents in to the liquid container.

Closed position as shown in the FIG. 3 is preferably referred as inactive position.

Open position as shown in the FIG. 5 is preferably referred as the active position.

In an embodiment of the present invention the cutting unit (11) and pushing rib (14) are brought in to ready-position on removal of peel-off ring (10).

In an embodiment of the present invention the top cap (8) and cutting unit (11) is a single piece component without the pushing rib.

In an embodiment of the present invention the top cap (8) and cutting unit (11) is a single piece component with the pushing rib.

In an embodiment of the present invention, seals (3) and (4) may be made of materials like aluminium foil, plastic, composite materials or the like.

In an embodiment of the present invention, the seal preferably is a heat seal foil.

According to yet another embodiment of the present invention the top cap mainly consists of cap threads, reservoir shaft, heat seal foil, peel-off ring, locator and silicone seal. The cap thread is used to mesh with thread on the beverage bottle. Reservoir shaft is placed to store additives and it also acts as housing for top cap unit. Seal (3) which may be a heat seal foil is used to separate additives and beverages.

FIG. 10 shows closed position and open position of embodiment of FIG. 9. The pair of column on the top cap provides rigidity to the top cap, should the top cap be made of soft materials.

The material which can be used for heat seal foil may be selected from but not limited to laminates such as 20 micron Aluminum (Alu), 9 micron polyester, and 30 gsm LDPE (low-density polyethylene); 50μ HS LDPE +40μ Alu foil +125 gsm LDPE Foam +12μ Pet (poly ethylene terephthalate)—Plain; 20μ Alu Foil (Soft)/200 Gauge Poly—Plain; 30 Micron soft Alu foil/12 Micron Pet/200 Gauge Poly; 50 gsm Paper/200 Gauge Poly—Plain; 25μ Alu Foil (Soft)/200 Gauge Poly—Plain; 30μ Alu Foil (Soft)/200 Gauge Poly—Plain, 40μ Alu Foil (Soft)/200 Gauge Poly—Plain; 12μ Pet/12μ Alu Foil (Soft)/200 Gauge Poly—Plain. All these could be used for HDPE (high-density polyethylene) bottles.

For PET bottles following materials could be used as heat seal foil may be selected from but not limited to laminates such as 12μ HS Pet +40μ Alu Foil +125 gsm LDPE Foam +12μ Pet—Plain; 12μ HS Pet +20μ Alu Foil +125 gsm LDPE Foam +12μ Pet—Plain; 20μ Alu Foil (Soft)/12μ HS Pet—Plain, 50 gsm Paper/12μ HS Pet.

The peel off seal engaged with beverage bottle is to be broken once bottom cap is unscrewed. Locator is a protrusion on outer side of reservoir shaft located near the top which acts as a cam guide for top cap unit. Cam slot is the slot provided in the top cap to convert the radial motion of twist to axial motion for piercing the foil using piercer to discharge the content. If any softer materials are used, then pair of column (16) is provided; FIG. 9.

Annular liner (4) preferably made of silicone is used to avoid leakage of water or any other liquid from container to cap if there is any gap between top and bottom cam unit. (FIG. 9)

A cutting unit is provided which acts like a knife. The length of which can be adjusted as per requirement for 7.5 ml capacity suitably kept at approximately 44.49 mm. This cutting unit will help to breach the heat seal foil to disperse enclosed content.

Roughly the length of column for 7.5 ml capacity is 18.70 mm which is added in top cap unit.

Materials used for construction of cap preferably are polypropylene, H110, Polycarbonate.

The annular liner placed in the cap weighs in 0.3 to 0.7 gm range. The capacity of the cap is up to 7.5 ml and if it is brim-full then it could occupy up to 8.7 ml.

Size of cap can be varied at the bottle neck part. Cap sizes could be modified to suit different type of neck sizes in bottles (19 mm, 28 mm, 29 mm, 32 mm etc.). Brand name or the company name can be encrypted on the top of cap or on the peel off seal. For additional protection, sleeves could be placed as a protective covering on the cap. The material which could be used preferably silicone.

The beverage container in the doser cap of the present invention may contain potable drinking water or sweetened water or carbonated water, or any other liquid with or without pre-existing additives.

The one or more components of the doser cap of the present invention, more preferably are made from plastic material such as polypropylene copolymers.

The doser cap of the present inventions stores powder and/or undiluted liquid that can be directly dispensed into the container below by rotation of the cap when desired by the user. The doser cap of the present invention may be made available as single unit. The doser cap of the present invention may or may not be packed with the container.

Diameter of the doser cap of the present invention can be separately designed for conventional bottles and liquid containers whose diameters range from 19 mm to 33; preferably between 25 to 33 mm.

As another embodiment of the present invention, the contents of the doser cap may be released in to any other external container.

The doser cap of the present invention finds application in food industry as well as in pharmaceuticals and nutraceuticals.

Accordingly, those of ordinary skill in the art will recognize that various changes and modifications of the embodiments described herein can be made without departing from the scope of the invention. In addition, descriptions of well-known functions and constructions are omitted for clarity and conciseness.

The invention claimed is:

1. A doser cap for a liquid container enclosing additives for release in the said liquid container, the doser cap comprising:

a bottom cap unit comprising internal threads to engage with threads on the liquid container, and a reservoir shaft, wherein a bottom side of the reservoir shaft is sealed with a seal, and wherein the bottom cap unit has a cam guide on an outer portion of the reservoir shaft;

a top cap unit comprising:

a cam slot that engages with the cam guide on the bottom cap unit such that the top cap unit moves spirally down or up as per direction of rotation;

a peel-off ring that is in contact with the bottom cap unit and the top cap unit;

a cutting unit having a cutting tip for piercing the seal of the reservoir shaft of the bottom cap unit and a cutting edge on an inner portion of the top cap unit for shearing the seal on rotation of the top cap unit in a desired direction to discharge additives from the said reservoir shaft of the bottom cap unit;

a pushing rib perpendicular to the cutting unit for preventing the seal from pushing back upwards when cut or sheared; and an entry groove for smooth entry of the cam guide into the cam slot of the top cap unit, locking the bottom cap unit with the top cap unit such that the cutting unit resides inside the reservoir shaft.

2. The doser cap according to claim 1, wherein the bottom cap unit has a provision to be sealed with a mouth of the liquid container by a peel-off seal.

3. The doser cap according to claim 1, wherein the bottom cap unit further comprises of an annular liner housed around the reservoir shaft.

4. The doser cap according to claim 3, wherein the annular liner is an expanded polyethylene liner.

5. The doser cap according to claim 1, wherein the top cap unit further comprises a pair of columns.

6. The doser cap according to claim 1, wherein the desired direction to discharge the additives is an anti-clockwise direction.

7. The doser cap according to claim 1, wherein the desired direction to discharge the additives, is a clockwise direction.

8. The doser cap according to claim 1, wherein the entry groove is provided for smooth entry and assembly of the top and bottom cap units.

9. The doser cap according to claim 1, wherein the reservoir shaft has a capacity of up to about 7.5 ml.

10. The doser cap according to claim 1, wherein the doser cap is made from polypropylene co-polymers.

* * * * *